United States Patent [19]

Petro

[11] 4,194,366

[45] Mar. 25, 1980

[54] TWO SPEED VALVES AND BI-DIRECTIONAL MOTOR SYSTEM

[75] Inventor: John D. Petro, Youngstown, Ohio

[73] Assignee: Commerical Shearing, Inc., Youngstown, Ohio

[21] Appl. No.: 915,189

[22] Filed: Jun. 13, 1978

[51] Int. Cl.[2] ..... F15B 11/16

[52] U.S. Cl. ..... 60/483; 60/484; 60/905

[58] Field of Search ..... 60/483, 484, 905, 425, 60/427

[56] References Cited

U.S. PATENT DOCUMENTS

| | | | |
|---|---|---|---|
| 3,421,389 | 1/1969 | Fauchere | 60/484 X |
| 3,757,524 | 9/1973 | Poyner et al. | 60/483 |
| 3,768,263 | 10/1973 | Olson et al. | 60/483 |

*Primary Examiner*—Edgar W. Geoghegan

*Attorney, Agent, or Firm*—Buell, Blenko & Ziesenheim

[57] ABSTRACT

A two speed valve and bi-directional motor system is provided having a pair of motors, means for delivering pressure fluid selectively to either side of said motors, a two speed valve means receiving fluid on one side of said motors to selectively direct the fluid to one or both motors to provide high or low speed operation thereof and flow sensing means automatically connecting the discharge from the motors to the one motor not receiving fluid when the two speed valve is shifted to divert all fluid to one motor so that fluid is recirculated through said motor.

7 Claims, 10 Drawing Figures

TWO SPEED VALVES AND BI-DIRECTIONAL MOTOR SYSTEM

This invention relates to two speed valves and bi-directional motor systems operable at two speeds in at least one direction and particularly to a bi-directional motor system and two speed valve which can be shifted during movement without building up excessive pressures and with complete safety to operators and equipment.

Bi-directional motor sytems are well known in the prior art and a common use for such systems is in the operation of winches, particularly on lifting equipment such as cranes. In such winches it is common to have a winch drum driven by two hydraulic motors on a common shaft, operable in two directions for lifting and lowering and valved so that during lowering all the fluid can be fed through a single motor for high speed operation or can be divided for low speed operation. There have, however, been many problems with such arrangements. In the systems heretofore available, on shift to high speed lowering, one motor is cut off from hydraulic fluid and there is a tremendous build up of pressure in the housing which may cause a rupture of the housing or at the very least a drastic reduction in the life of the drive system. This is not costly in reduction of life of equipment but it is also dangerous to workmen. These problems have existed for years and the only solution was a skilled operator and excellent brakes on the drum.

The present invention provides a two speed valve and a bi-directional motor system incorporating such two speed valve which eliminates these problems and provides a system counterbalanced for both motors with freedom to shift from low to high speed operation without danger of pressure build up. In this system the apparatus cannot be damaged even if the operator makes an error and shifts to high speed lowering with a heavy load which should only be lowered at low speed.

I provide a bi-directional motor system comprising a pair of bi-directional motors, a source of fluid under pressure, directional valve means receiving fluid from the source of fluid under pressure for delivering fluid under pressure selectively to one side or the other of the two motors, a counterbalance valve on one side of said motors between said directional valve means and one side of the two motors, a two speed valve means on the other side of said motors between said directional valve means and the two motors selectively delivering fluid to the other side of at least one of said motors whereby the fluid is all delivered to one of said motors or divided between the two motors for high speed or low speed operation thereof, flow sensing valve means communicating with the two speed valve means and to the said one side of said motors, said flow sensing valve means sensing the change in fluid flow between said motors from said two speed valve, means connecting said flow sensing valve to the side of the motors opposite the two speed valve whereby fluid leaving said motors is recirculated through one of said motors when the other is receiving all fluid from the two speed valve. Preferably a normally engaged brake is provided acting on the motor shaft with connections from the two speed valve releasing the brake while fluid is delivered through the two speed valve.

In the foregoing general description I have set out certain objects, purposes and advantages of this invention. Other objects, purposes and advantages will be apparent from a consideration of the following description and the accompanying drawings in which.

Figure 1:
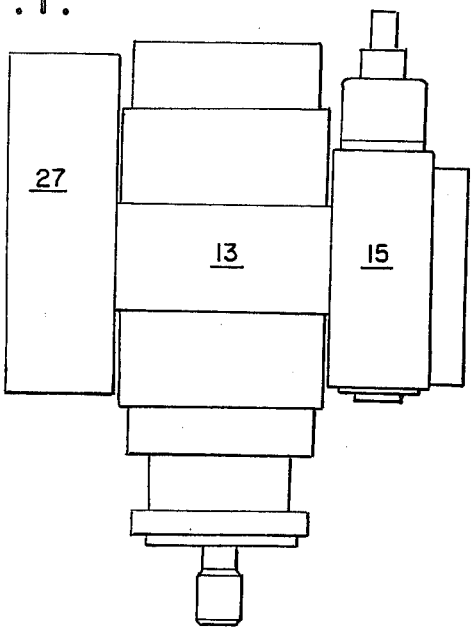
FIG. 1 is a top plan view of a bi-directional motor assembly according to this invention.
Figure 2:
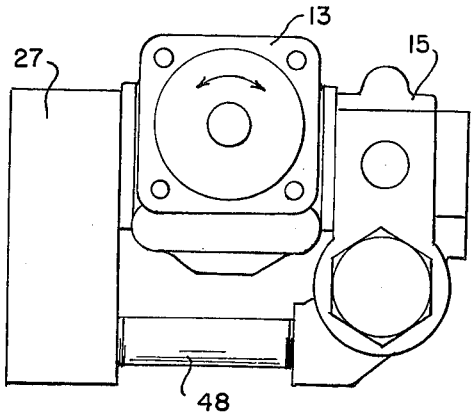
FIG. 2 is an end elevation of the assembly of FIG. 1.
Figure 5:
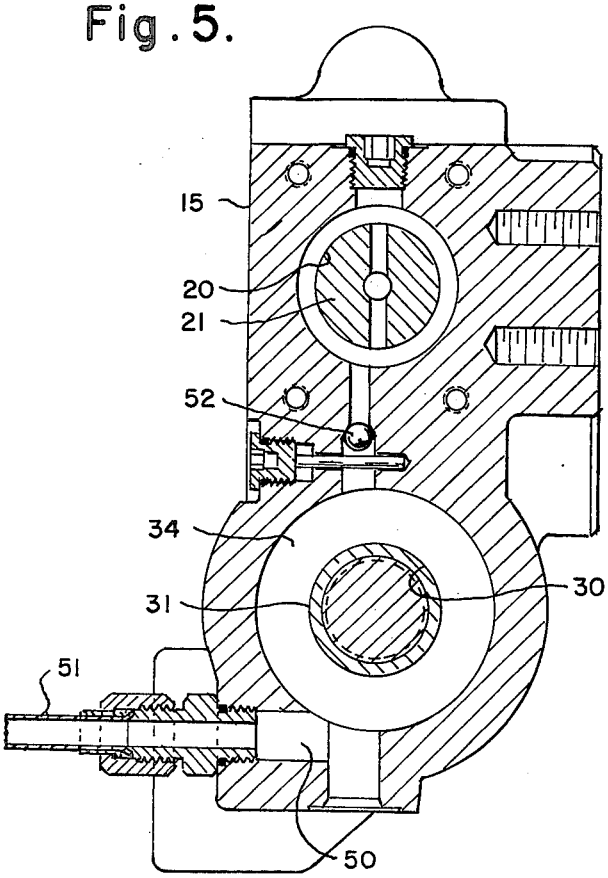
FIG. 5 is a section on the line V—V of FIG. 4.
Figure 6:
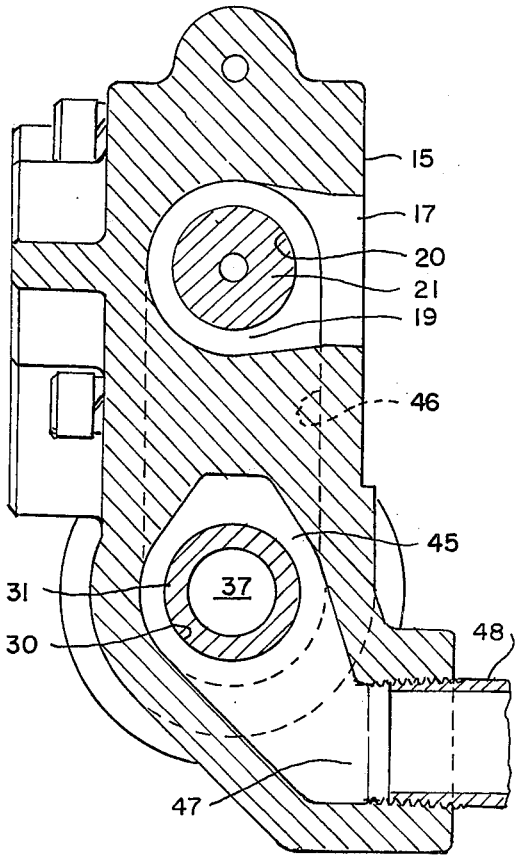
FIG. 6 is a section on the line VI—VI of FIG. 4.
Figure 3:
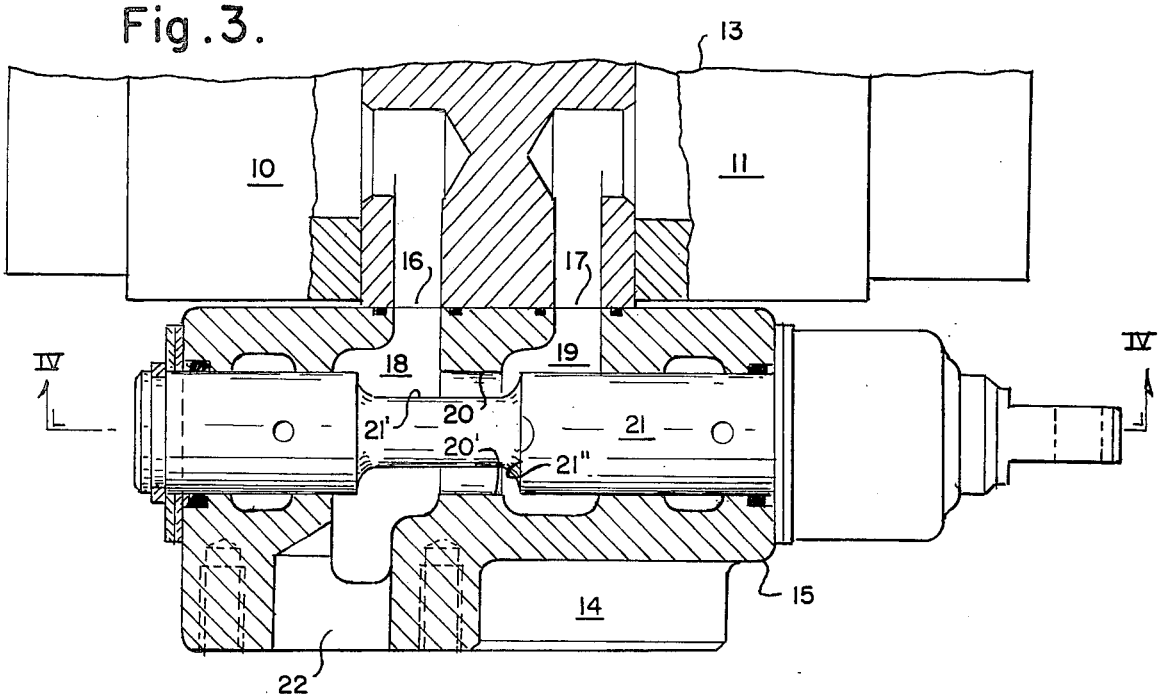
FIG. 3 is a fragmentary top plan view partly in section of a twin motor and two speed valve assembly as used in FIGS. 1 and 2.
Figure 4:
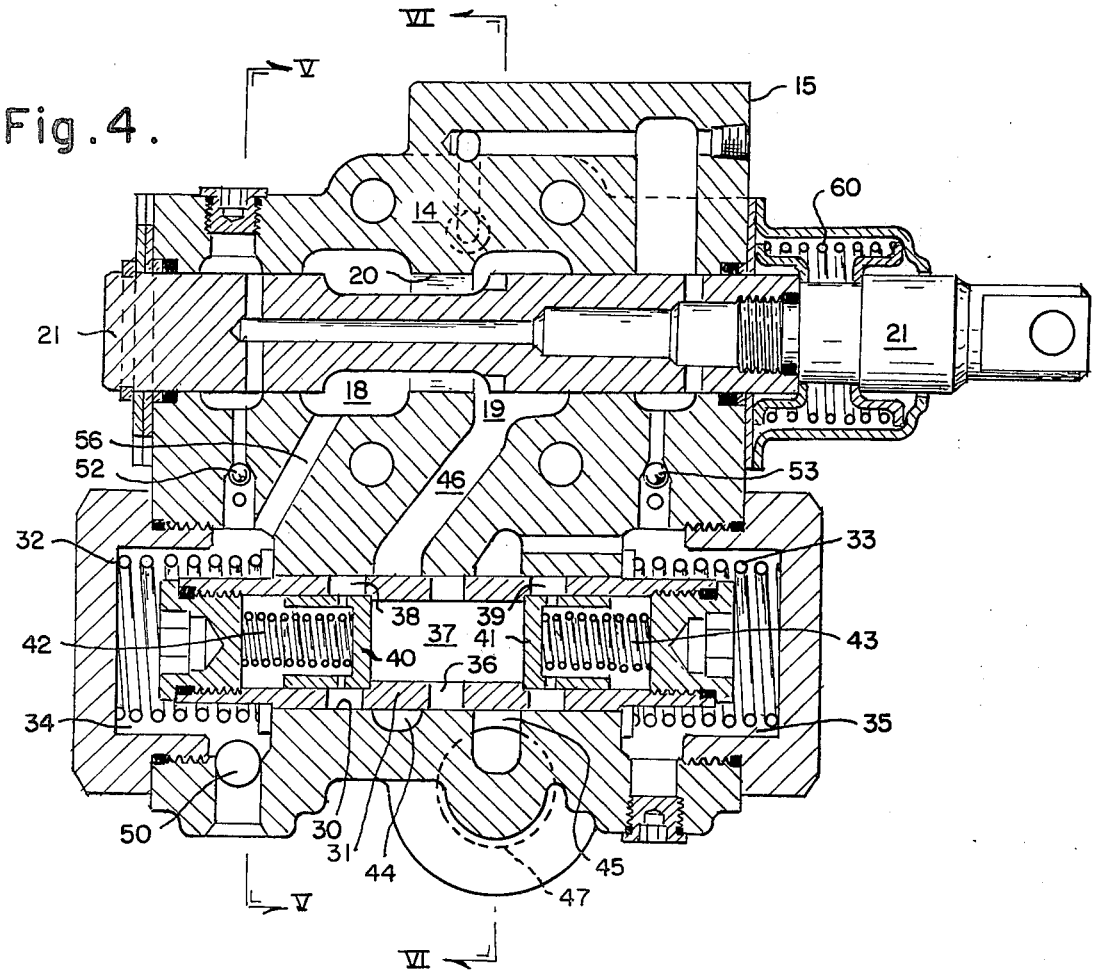
FIG. 4 is a section on the line IV—IV of FIG. 3.

Referring to the drawings I have illustrated schematically motors 10 and 11, which are preferably gear motors housed in a single housing 13 on a common shaft. A two speed valve 14 having a housing 15 mounted on motor housing 13 is provided with two outlet ports 16 and 17, communicating from chambers 18 and 19 spaced along a longitudinal bore 20, to each of motors 10 and 11. A valve spool 21 is movable in bore 20 from a low speed position, shown in FIGS. 3 and 4 in which chambers 18 and 19 are connected through a groove 21' in spool 21, to a high speed position in which shoulder 21'' abuts the central portion 20' of bore 20 which separates chambers 18 and 19, thereby separating chambers 18 and 19. A fluid input port 22 in housing 15 communicates with chamber 18 and with inlet line 23 from directional control valve 24 between pump 25 and valve 14. Second fluid inlet ports on the opposite side of motor housing 13 connect both motors 10 and 11 through lines 58 and 59 with pump 25 by way of control valve 24, line 24' counterbalance valve 27 and by pass line 28. Within housing 15 there is provided a second bore 30 generally parallel to and spaced from bore 20. A hollow valve spool 31 is normally centered in bore 30 by springs 32 and 33 in chambers 34 and 35 at either end of bore 30. Spool 31 is provided with radial passages 36 at the center of the spool communicating through the spool wall to an inner chamber 37 within the spool. Radial passages 38 and 39 are provided adjacent either end of spool 31 and are covered by check valves 40 and 41 which are spring-loaded by springs 42 and 43 to closed position covering said passages 38 and 39. Bore 30 is provided with two spaced apart chambers 44 and 45. Chamber 44 is connected to chamber 19 by passage 46. Chamber 45 is connected to an inlet port 47 which connects to line 48 which is in turn connected to line 24'. A brake release port 50 is connected by line 51 to a normally engaged brake actuating motor **51*a* so that when chamber 18 is pressurized fluid will pass through line 56 to chamber 34, port 50 and line 51 to release the brake in the system as the motors 10 and 11 are energized. At the same time spool 31 will be moved to the right, viewing FIG. 4, with passages 38 connected to chamber 44 and passage 36 connected to chamber 45. Check valves 52 and 53 are provided in housing 15 connecting bore 20 at its opposite ends with chambers 34 and 35. Check valve 52** connects counterbalance valve 27 by means of line 54 with bore 20 and check valve 53 connects to the motor seal drain by line 55.

In operation motors 10 and 11 are connected to a common drive shaft which in turn is connected to a winch drum or similar apparatus to be driven. Assuming that a winch or cable drum on a crane is being driven, the motors 10 and 11 are connected so that fluid going from directional control valve 24 will go through line 24' to motors 10 and 11 and will be divided equally between them and the drum will be rotated to raise the load. This is a normal type of operation. When the load is to be lowered, directional control valve 24 is moved in the opposition direction to deliver fluid to line 23 and into chamber 18 where it will be normally divided with chamber 19 and to both motors for low speed lowering. When fluid enters chamber 18 it also goes through passage 56, chamber 34 and line 51 to release the brake and moves valve 31 to the right. If the operator desires to lower the load at high speed he moves valve spool 21 to the left against centering spring 60 which closes the connection from chamber 18 to chamber 19 and passes all fluid through motor 10 which now operates at twice the speed. At the same time fluid is recirculated from line 48 through chamber 45, openings 36, chamber 37, check valve 40, openings 38, passage 46 into chamber 19 and through motor 11 so as to protect motor 11 against loss of lubricant as well as excess pressure build up.

In order that the operation of this invention may be clearly understood I shall describe the fluid flow in each of the four operating positions for operating a cable winch.

Figure 7:
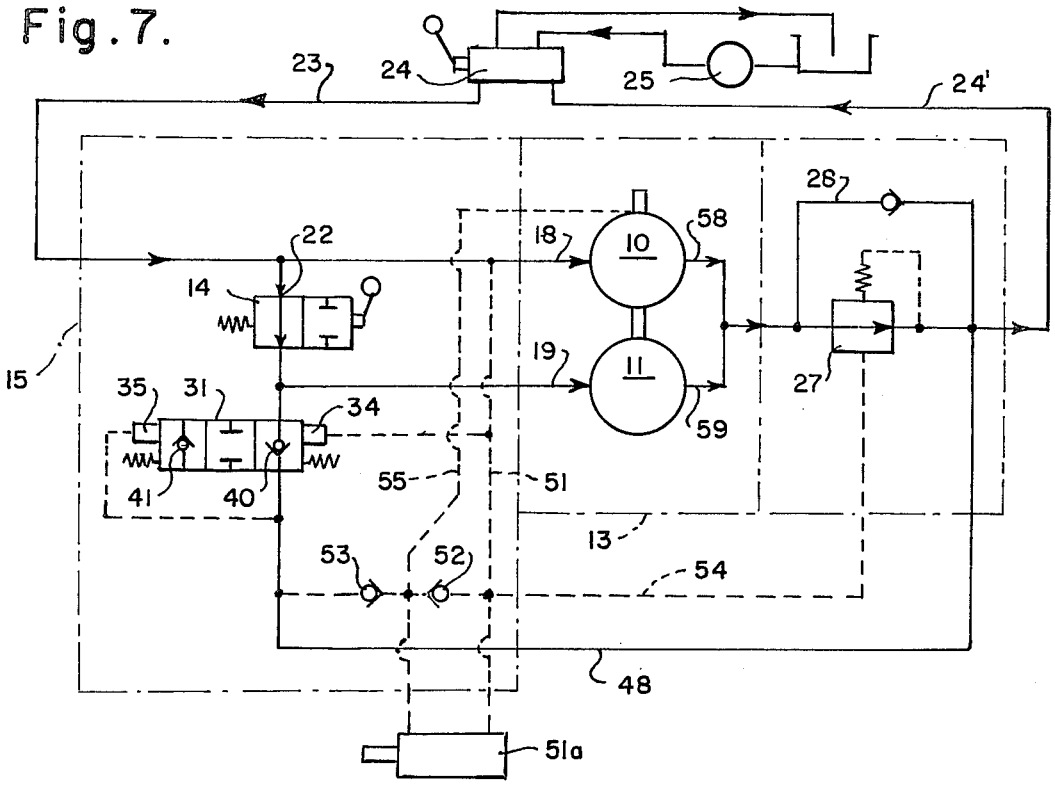
FIG. 7 is a schematic hydraulic circuit incorporating the two speed motor of this invention in low speed lower position.

FIG. 7 illustrates schematically the hydraulic circuit in low speed lowering position. Flow of fluid from pump 25 enters valve 14 from line 23. A pressure signal is communicated from line 23 to chamber 34 through line 51. This signal shifts spool 31 allowing check valve 40 to be positioned to pass fluid between chambers 44 and 45 when the valve 14 is subsequently shifted to high speed lowering. A signal then passes to brake actuating motor 51*a* to release the winch (not shown) through chamber 34, port 50 and line 51. The inlet flow from line 23 divides, entering motor 10 through chamber 18 and motor 11 through chamber 19. Fluid passes through motors 10 and 11 and into counterbalance valve 27 which allows it to return to tank when a positive signal pressure is maintained in lines 51, 54 and 23.

Figure 8:
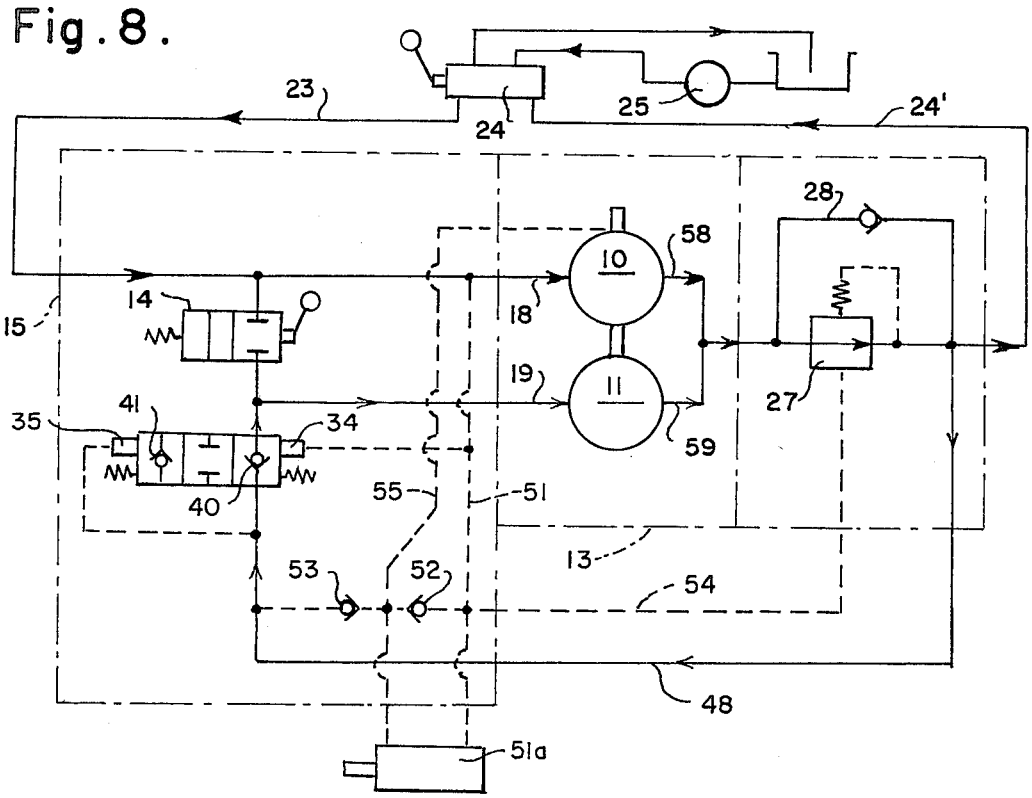
FIG. 8 is a schematic hydraulic circuit as in FIG. 7 with the motor in high speed lower position.

In FIG. 8 I have illustrated the hydraulic circuit in high speed lowering position. This is obtained by shifting spool 21 to the left (FIG. 3) to prevent fluid entering port 22 from going to chamber 19. When this occurs pressure from line 23 forces flow sensing spool 31 to the right causing fluid to recirculate from counterbalance valve 27 through line 48, check valve 40 and chamber 19. The flow from both motors coming from lines 57 and 58 is combined in counterbalance valve 27 through which the flow is metered. The inlet pressure at chambers 18 and 19 is low in relation to the outlet pressure in lines 58 and 59 due to the winch load trying to convert the motor into a pump when lowering, due to the load on the winch.

Figure 9:
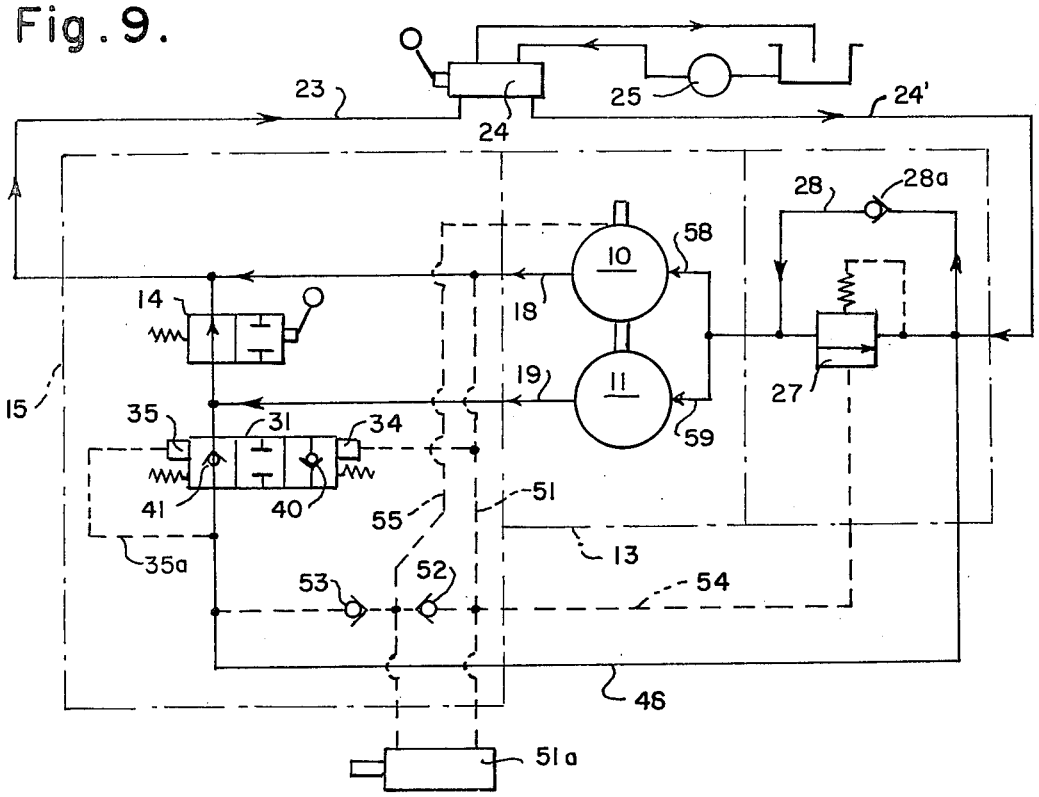
FIG. 9 is a schematic hydraulic circuit as in FIG. 6 with the motor in low speed raise position.

Illustrated in FIG. 9 is the circuit in low speed raise or lift. Fluid enters the system through line 24' from directional control valve 24 and passes through both motors 10 and 11 by way of by-pass line 28, check valve 28*a* and lines 57 and 58 and then out through chambers 18, 19 and through line 23 and valve 24 back to reservoir. Flow sensing spool 31 is shifted to the left (viewing FIG. 4) by inlet pressure at line 24' acting through line 48, bleed line 35*a* and chamber 35. This movement of spool 31 places check valve 41 in communication with line 46 and chamber 45.

Figure 10:
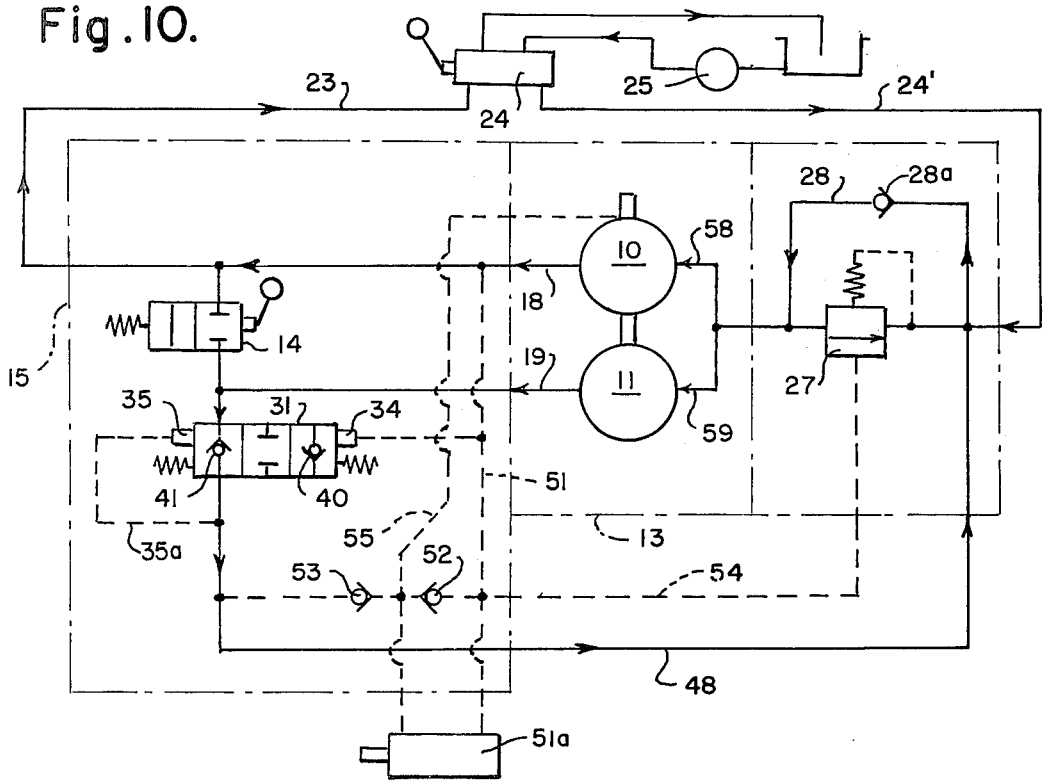
FIG. 10 is a schematic hydraulic circuit as in FIG. 6 with the motor in high speed raise position.

FIG. 10 illustrates the circuit in high speed raise or lift. In this position spool 21 has been shifted to the left (viewing FIGS. 3 and 4) to a position which prevents communication from port 22 to chamber 19. Flow sensing spool 31 is shifted by inlet pressure in line 24' so that check valve 41 is in communication between line 46 and chamber 45. Fluid enters the motors from line 24' and is combined with recirculating fluid flow from motor 11 by way of chamber 19, line 46, check valve 41 and chamber 45. The combined flow passes through check valve 28*a* and through lines 58 and 59. The flow through line 58 passes through motor 10, chamber 18, and line 23 back to reservoir. Flow through line 59 passes through motor 11 to provide lubrication and then recirculates through chamber 19, line 46, check valve 41 and chamber 45.

By providing means for recirculation of fluid in motor 11 during both high speed lowering and raising, the speed of the motor is increased.

In the foregoing specification I have set out certain preferred practices and embodiments of my invention, however, it will be understood that this invention may be otherwise embodied within the scope of the following claims.

I claim:

1. A bi-directional motor system comprising a pair of bi-directional motors, a source of fluid under pressure, directional valve means receiving fluid from the source of fluid under pressure and delivering the same selectively to one side or the other of the two motors, a counterbalance valve on one side of said motors between said directional valve means and one side of the two motors, a two speed valve means on the other side of said motors between said directional valve means and the two motors selectively delivering fluid to the other side of at least one of said motors, said valve having a first position wherein the fluid is delivered equally to both said motors for low speed rotation and a second position wherein all fluid is delivered to one of said motors for high speed rotation, flow sensing valve means communicating with the two speed valve means and with said one side of said motors, said flow sensing valve means being closed when the two speed valve is in first position and open to recirculate fluid from said one side of the motors through the other of said motors when said two speed valve is in its second position.

2. A bi-directional motor system as claimed in claim 1 including a normally engaged brake means acting on the motor shaft, fluid actuated means for releasing the brake and a connection from the two speed valve delivering fluid to said fluid actuated means in both positions of said valve.

3. A bi-directional motor system as claimed in claim 1 wherein the counterbalance valve is normally spring biased to the closed position, a connection from the two speed valve to said counterbalance valve delivering fluid thereto in both positions of said valve for overcoming said bias and opening the counterbalance valve.

4. A bi-directional motor system as claimed in claim 3 wherein a normally engaged brake means acting on the motor shaft is provided, fluid actuated means on the brake means releases the brake, and a common connection with the counterbalance valve delivering fluid simultaneously to the counterbalance valve and fluid actuating means to open the counterbalance valve and release the brake means.

5. A bi-directional motor system as claimed in claim 1 wherein the flow sensing means is a valve spool normally centered in a bore, a hollow chamber at each end of the bore, resilient means in each chamber normally biasing the spool centrally of the bore, a first connection intermediate said bore to the two speed valve means, a second connection intermediate said bore spaced from said first connection extending from said bore to the said one side of said motors and a connection from one of said chambers to said two speed valve means delivering pressure fluid to said chamber in both positions of the two way valve whereby said spool is shifted to connect said first and second connections for delivering fluid from said one side to said motors to the other of said motors when said two speed valve is in its second position.

6. A two speed valve structure particularly adapted for use with bi-directional paired motors comprising a housing, a first bore in said housing, a pair of spaced chambers intersecting said first bore intermediate its length, outlet ports from each said chamber, each port connecting to a separate motor for delivery of fluid thereto, an inlet port in one of said chambers receiving hydraulic fluid from a source of fluid under pressure, a valve spool in said first bore, said spool having a groove portion connecting said spaced chambers in a first position to deliver fluid to both outlet ports and closing said one chamber from the other chamber in a second position, a second bore in said housing spaced from the first bore, said second bore having chambers at each end and first and second spaced intermediate chambers intersecting said bore, a second valve spool in said second bore, resilient means normally centering said spool in a first position in said bore, a passage connecting said one chamber of the first bore with one end chamber of said second bore whereby said second valve spool is shifted by fluid in said one chamber to a second position, connecting means in said second valve spool connecting said first and second intermediate chambers in said second position, a connection from said first intermediate chamber to said other chamber in the first bore and a port in said second intermediate chamber adapted for connection to a source of recirculating fluid.

7. A two speed valve structure as claimed in claim 6 including an outlet port from said one end chamber adapted for connection to an auxiliary fluid operated mechanism for simultaneous operation with said two speed valve.

* * * * *

UNITED STATES PATENT AND TRADEMARK OFFICE

CERTIFICATE OF CORRECTION

PATENT NO. : 4,194,366

DATED : March 25, 1980

INVENTOR(S) : JOHN D. PETRO

It is certified that error appears in the above-identified patent and that said Letters Patent are hereby corrected as shown below:

Claim 5, column 5, line 16, after "side", "to" should read --of--.

Signed and Sealed this

*Eighth* Day of *July 1980*

[SEAL]

*Attest:*

SIDNEY A. DIAMOND

*Attesting Officer*

*Commissioner of Patents and Trademarks*